United States Patent [19]

Georgopoulos

[11] 4,165,804

[45] Aug. 28, 1979

[54] CIGARETTE PACKAGE CLOSURE AND PROTECTOR

[76] Inventor: Minas Georgopoulos, 32-70 33th St., Long Island City, N.Y. 11106

[21] Appl. No.: 932,450

[22] Filed: Aug. 9, 1978

Related U.S. Application Data

[63] Continuation of Ser. No. 846,539, Oct. 28, 1977, abandoned.

[51] Int. Cl.[2] ..... A25F 15/00; A25F 27/00; B65D 85/10

[52] U.S. Cl. ..... 206/259; 206/95; 220/254

[58] Field of Search ..... 206/259, 94, 95, 266, 206/102, 103, 38, 236, 86, 118, 119; 131/239; 220/254

[56] References Cited

U.S. PATENT DOCUMENTS

| | | | |
|---|---|---|---|
| 1,892,676 | 1/1933 | McEnery | 206/259 |
| 1,917,427 | 7/1933 | Brudney | 206/259 |
| 2,222,743 | 11/1940 | Florman | 206/259 |
| 2,285,836 | 6/1942 | Rettenmeyer | 206/103 |
| 2,547,620 | 4/1951 | Capano | 206/94 |

FOREIGN PATENT DOCUMENTS

| | | | |
|---|---|---|---|
| 563608 | 11/1932 | Fed. Rep. of Germany | 206/259 |
| 145506 | 2/1931 | Switzerland | 206/259 |

*Primary Examiner*—William T. Dixson, Jr.
*Attorney, Agent, or Firm*—Constantine A. Michalos; Peter C. Michalos

[57] ABSTRACT

A closure and protector for covering an upper end of a conventional soft pack cigarette package is disclosed having a pair of parallel, spaced, U-shaped members with orthogonally extending upper portions forming a framework. A stationary cover member is fixed to the upper portions of the framework and extends over a major portion of the top surface of the cigarette package. A smaller lid portion is hinged to the stationary cover portion and includes a catch means engageable with the frame to maintain the lid portion in a closed position. A lid biasing means is included for biasing the lid portion toward an open position. A book-match retaining means is pivotally attached to an exposed portion of the frame in an aperture in the stationary cover member.

6 Claims, 7 Drawing Figures

CIGARETTE PACKAGE CLOSURE AND PROTECTOR

This is a continuation of application Ser. No. 846,539 filed Oct. 28, 1977 now abandoned.

BACKGROUND OF THE INVENTION

1. Field of the Invention

This invention relates to closure devices for covering an upper end of the conventional, generally rectangular, flexible cigarette package after the package has been opened to expose the upper end of at least some of the cigarettes contained therein and particularly to such devices which are adapted to coact with the original package in which the cigarettes are contained.

2. Description of the Prior Art

Many brands of cigarettes, perhaps the great majority, are sold in a generally rectangular yet flexible package often referred to in the art as a soft pack. Such a soft pack generally includes a foil inner wrapper, an indicia-bearing middle layer, and a transparent outer wrapper. It is a common practice to remove a portion of one end of the package so as to reveal an end of at least some of the cigarettes contained therein, thereby enabling the smoker to withdraw one or more cigarettes from the package. After several of the cigarettes have been withdrawn from the package, the package as a whole tends to lose the stiffness or body which it had initially, and as a result, the cigarettes remaining in the package have a tendency to become crushed or broken. Some of the tobacco filler will occassionally sift out of the ends of the cigarettes contained within the package, and further, the end of the cigarette exposed has a tendency to become soiled, thus rendering them unusable for the intended purpose of smoking.

Another common annoyance or problem experienced by cigarette smokers is the misplacing of the smoker's supply of matches intended to be used in lighting the cigarettes. This is particularly true with the use of the relatively compact packages of paper safety matches now extensively employed and commonly obtained at little or no cost to the smoker.

It is therefore an object of the present invention to overcome the foregoing difficulties by providing a protective closure for cigarette soft packs which includes a book-match retaining means. More specifically, a protective closure device is provided which is adapted to be received between various layers of the cigarette package to provide a covering over the opened end of the package, the closure including a means for maintaining a book of paper matches closely against the side of the cigarette pack, thereby leading to a compact arrangement in which the matches conveniently accompany the pack of cigarettes.

A number of prior art protective devices for packages of cigarettes are known to exist in the prior art. Examples of the prior art are to be found in U.S. Pat. Nos. 1,758,406; 1,892,676; 1,917,427; 1,957,302; 2,222,743, 2,782,910; and 3,743,136.

SUMMARY OF THE INVENTION

The cigarette package closure of the present invention is designed to cover the upper end of the conventional, position rectangular, flexible cigarette package after the package has been position to expose the upper end of at least some of the cigarettes contained therein. The closure has a frame which comprises a pair of parallel, spaced U-shaped members having upper portions which extend orthogonally toward the corresponding upper portion of the opposite member of the pair. The frame may be formed from a single unitary wire member shaped to house the specified configuration. The closure further includes a stationary cover member fixed to the upper portion of the frame and extending over a major portion of the surface defined by the upper portions of the frame. The cover member has at least one aperture exposing, along one edge, a portion of the frame and further comprises a clip member downwardly depending from the opposite edge intended to engage the lip of a shirt pocket or the like between the clip member and the body of the cigarette package to which the closure is attached.

The closure further has a lid portion hinged to the stationary cover member and displaceable between a closed positio coplanar with the stationary cover member and an open positio generally orthogonal thereto. The lid portion includes a catch means engageable with the frame for maintaining the lid portion in the closed position. A lid biasing means is fixed to the stationary cover member and contacts the disposable lid portion for biasing the lid portion toward the open position.

A book-match retaining means is attached to the portion of the frame which is exposed in the aperture or apertures in the stationary cover member. The book-match retaining means is adapted to hold a conventional book of paper matches and comprises a depending lip portion insertable between a back layer of the paper matches and a rear portion of the cover enveloping the paper matches. A slot through the book-match retaining means receives the front cover and top of the enveloping cover thereby conveniently positioning the matches adjacent the cigarette package. The book-match retaining means is preferably conveniently locatable about the portion of the frame to which it is attached thereby facilitating an easy insertion and removal of the book of matches.

The stationary cover member and lid portion are preferably decoratively embossed on a top surface solely to present an unobtrusive package closure. It is intended that the cigarette package closure according to this invention close the cigarette package after it has been opened in order to preserve, in large measure, the freshness of the cigarettes and to reduce the possibility of contamination from outside substances as for example would occur when working around chemicals, vapors, liquids, or dust that might penetrate the end of the cigarettes if not covered.

One feature of this invention is to be found in the latch arrangement for the spring biased lid portion which is operated by manipulating the frame itself by simply squeezing the package with the frame inside. Another feature of this invention resides in the lightweight and inexpensive construction which facilitates its use while maintaining a low cost. An advantage of the present invention is presented by its adaptability to the various lengths of cigarette packages presently marketed by not materially adding to the dimensions of the packages as originally constructed. Another advantage is to be found in the closure's ready adaptability to be combined with or detached from a cigarette package with which it is employed.

Other features and advantages of the present invention will become apparent upon reading the following description of preferred embodiment in conjunction with the accompanying drawings.

DESCRIPTION OF PREFERRED EMBODIMENT

Figure 1:
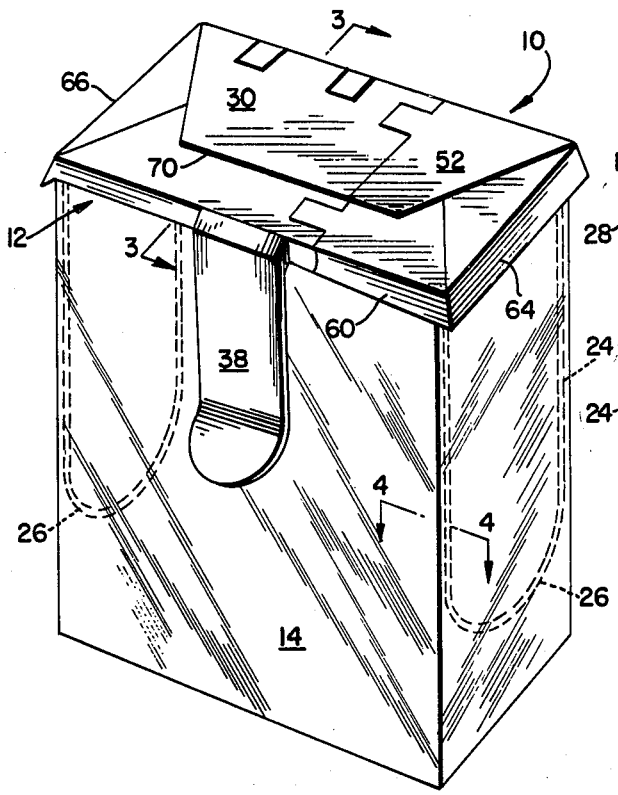
FIGS. 1 and 2 show reverse perspective drawings of a soft pack protector according to this invention as it would appear in combination with a cigarette package.
Figure 2:
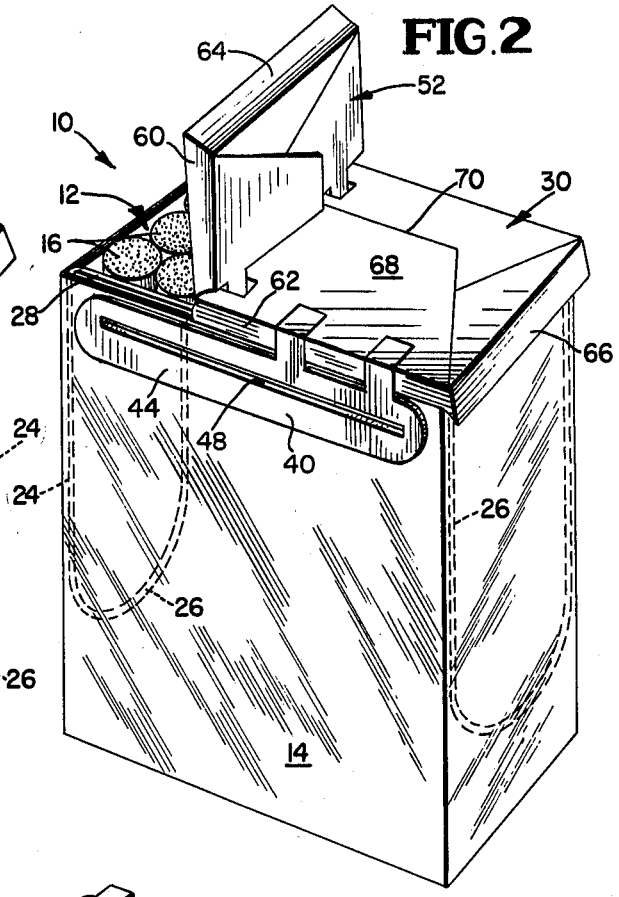
Figure 4:
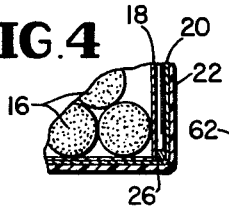
FIG. 4 is a partial sectional detailed view showing the arrangement of the layers of material which make up a cigarette package including several cigarettes as viewed on end illustrating the relative position of the wire frame of the present invention with respect to several layers of the soft pack.

A cigarette package closure 10 according to this invention for covering an upper end 12 of a generally rectangular, flexible cigarette package 14 is illustrated in reverse perspective views in FIGS. 1 and 2. The cigarette package closure 10 is generally used in combination with a so-called "soft pack" cigarette package 14 after the package has been opened to expose the upper end of at least some of the cigarettes 16 contained therein. The package 14 generally includes a foil inner wrapper 18, an indicia-bearing middle layer 20, and a transparent outer wrapper 22 as illustrated in FIG. 4.

Figure 5:
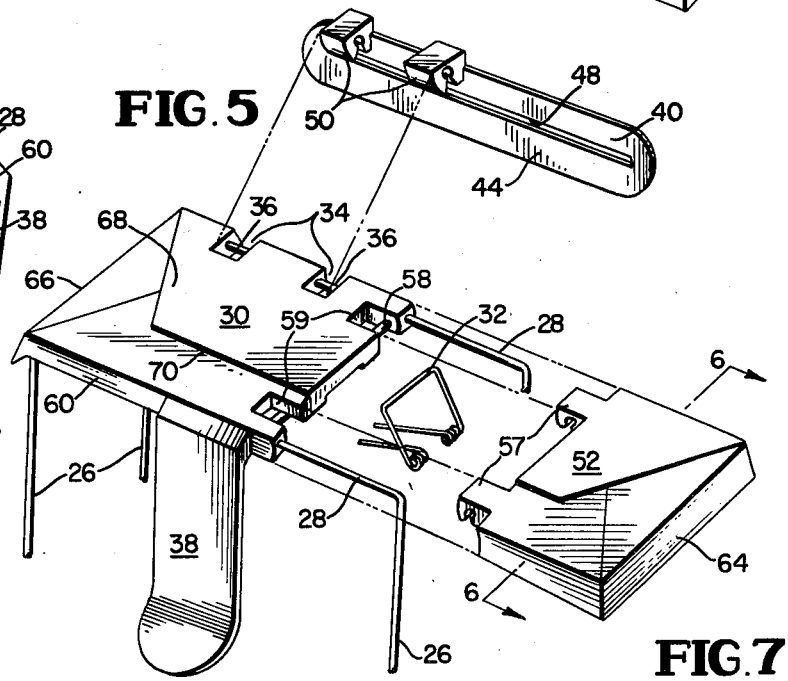
FIG. 5 shows an exploded view, slightly enlarged, of the several elements making up the soft pack protector according to this invention.

The cigarette package closure 10 according to this invention comprises a frame 24 comprising a pair of parallel, spaced U-shaped members 26. In use, the U-shaped members 26 are inserted between the foil inner wrap 18 and the indicia-bearing layer 20 of a cigarette package 14 after the package has been opened as illustrated in FIG. 4. An upper portion 28 of each of the U-shaped members 26 extends orthogonally toward the corresponding upper portion of the opposite member of the pair as illustrated most favorably in FIG. 5.

A stationary cover member 30 is fixed to the upper portions 28 of the frame 24 and extends over a major portion of the surface 32 defined by the upper portions 28 of frame 24. The stationary cover member 30 comprises apertures 34 exposing, along one edge, portions 36 of the frame 24. The stationary cover member 30 also comprises a clip member 38 downwardly depending from the edge opposite the apertures 34.

Figure 3:
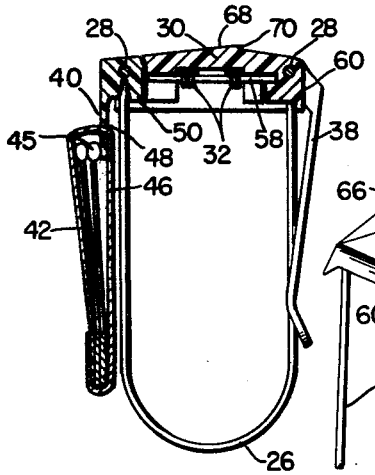
FIG. 3 is a sectional view taken from FIG. 1 cut along line 3—3 illustrating the presence of the book of matches in place in the holder.

The cigarette package closure 10 according to this invention also comprises a book-match retaining means 40 attached to frame portions 36 in apertures 34 of the stationary cover member 30 for holding a conventional book of paper matches 42 as illustrated in FIG. 3. The book-match retaining means 40 comprises a lip portion 44 for insertion between a back layer 45 of the paper matches 42 and a rear portion of the cover 46 enveloping the paper matches 42. The book-match retaining means 40 also comprises a slot 47 through which the enveloping cover 46 of the book of paper matches 42 may be inserted. Preferably, back edges 50 will be rounded or chamfered so as to permit a rotational movement of the bookmatch retaining means 40 about the frame portions 36, thereby permitting easy insertion and removal of matchbooks 42 without requiring the removal of or causing interference with the top of the cigarette package 14.

Figure 6:
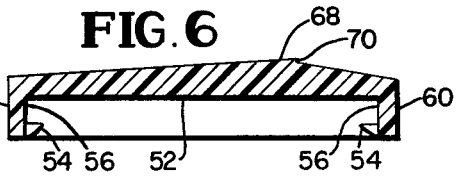
FIG. 6 is a sectional view of the hinged-lid portion of the soft pack protector enlarged still further.
Figure 7:
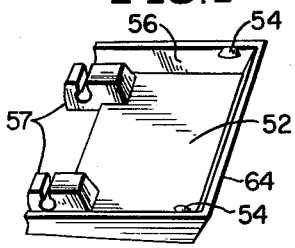
FIG. 7 is an inverted perspective view of the hinged-lid portion shown in FIG. 5.

The cigarette package closure 10 according to this invention further comprises a lid portion 52 hinged to the stationary cover member 30 hinge tabs 57 engaging pivot member 58 in hinge slots 59. The lid portion 52 is displaceable between a closed position coplanar with the stationary cover member as illustrated in FIG. 1 and an open position generally orthogonal thereto as illustrated in FIG. 2. The lid portion 52 includes a catch means 54 engagable with the frame 24 for maintaining the lid portion 52 in the closed position. As illustrated in FIGS. 6 and 7, the catch means 54 comprises a wedge-shaped integral portion extending inwardly from an inside wall 56 of the lid portion 52. A lid biasing means 32 fixed to the stationary cover 30 and contacting the displaceable lid portion 52 biases the lid portion 52 toward the open position. The catch means 54 engage the upper portions 28 of the frame 24 so as to retain the lid portion 52 in the closed position.

In the preferred embodiment, the front and rear walls 60 and 62 of the closure 10 are substantially parallel as illustrated in FIG. 6, whereas, the end portions 64 and 66 of closure 10 form a generally trapezoidal shape. The top 68 is impressed with the decorative seam 70 and slopes downwardly slightly from the decorative seam as is shown most dramatically in FIG. 6.

The soft pack protector 10 according to this invention can be used for the three major types of cigarettes: 70 mm., 85 mm., and 100 mm., as well as the newly introduced 120 mm. The length of the U-shaped members 26 can be such as will accomodate all the major sizes, which would be about $2\frac{3}{4}$ inches in length. The closure 10 can be made of any material capable of being formed to the shape illustrated. The preferable material is a suitable plastic having a high luster, low flammability and a high ignition point.

Although the invention has been described in considerable detail with reference to the preferred embodiment illustrated in the accompanying figures, it will be understood that variations and modifications can be effected within the spirit and scope of the invention as described above and as defined in the appended claims.

What is claimed:

1. A cigarette package closure for covering an upper end of a conventional, generally rectangular, flexible cigarette package after the package has been opened to expose the upper end of at least one of the cigarettes contained therein, the package generally including a foil inner wrapper, an indicia bearing middle layer, and a transparent outer wrapper, the closure comprising; a frame comprising a pair of parallel, spaced, U-shaped members having upper portions which extend orthogonally toward the corresponding upper portion of the opposite member of the pair; a stationary cover member fixed to said upper portions of the frame and extending over a major portion of the surface defined by said upper portions of the frame, the cover member including at least two apertures along one edge thereof, exposing two portions of the frame, and comprising a clip member depending downwardly from the long edge of said cover member opposite said at least two apertures for engaging the lip of a shirt pocket or the like; a lid portion hinged to a short edge of the stationary cover member and displaceable between a closed position coplanar with the stationary cover member and an open position at an angle thereto, the lid portion including catch means engageable with said frame for maintaining said lid portion in its closed position; a lid spring fixed to said stationary cover member and contacting said displaceable lid portion for biasing said lid portion toward said open position; and a match-book retaining elongated lip portion hingedly connected to said portions of said frame exposed by said at least two apertures in said stationary cover member, for holding a conventional book of paper matches, the lip portion depending downwardly from said cover member and including a slot for insertion of the conventional book of paper matches between a back layer of the paper matches and a rear portion of the cover enveloping the paper matches, said lip portion being pivotable about said exposed frame portions by at least 180° to allow access to all sides of the covering enveloping the paper matches.

2. The apparatus of claim 1 further comprising a pair of slots in said stationary cover member adjacent said lid portion, a pair of hinge tabs extending from said lid portion into said pair of slots, and a pivot rod supported by the cover member across said slots and engaging the hinge tabs for pivotal motions thereabout.

3. The apparatus of claim 2 wherein said lid spring comprises a wire coiled about said pivot member in a pair of locations with an intermediate uncoiled portion extending in contact with the resiliantly displaced so as to force the rotation of the lid portion about said pivot member.

4. The apparatus of claim 1 wherein said stationary cover member and said lid portion are impressed on a top surface thereof with a decorative seam that resembles the top of a cigarette package, the remainder of the top surface sloping slightly downwardly from said decorative seam.

5. An apparatus according to claim 1 wherein said catch means comprising a pair of wedge shaped integral portions extending inwardly from an inside wall of said lid portion and engageable with said upper portion of said frame for retaining said lid portion in its closed position.

6. A cigarette package closure for covering an upper end of a conventional, generally rectangular, flexible cigarette package after the package has been opened to expose the upper end of at least one of the cigarettes contained therein, the package generally including a foil inner wrapper, an indicia bearing middle layer, and a transparent outer wrapper, the closure comprising:

a frame comprising a pair of parallel, spaced, U-shaped members having two parallel upper members which extend orthogonally toward the corresponding upper portion of the opposite member of the pair, a stationary cover member fixed to said upper portions of the frame and extending over a major portion of the surface defined by said upper portions of the frame, the cover member comprising, a pair of apertures exposing, along one long edge, a portion of the frame, a clip member depending downwardly from the edge opposite the pair of apertures for engaging the lip of a shirt pocket or the like between the clip member and the body of the cigarette package to which the closure is attached, a pair of slots adjacent the minor portion of said surface not covered by the stationary cover member, and a pivot member fixed so as to be engagable in the pair of slots, a lid portion for covering said minor portion of said surface and comprising a pair of hinge tabs extending into said pair of slots in the stationary cover member and engaging the pivot member whereby the lid portion is displaceable between a closed position coplanar with said stationary cover member and an open position generally orthogonal thereto, said lid portion in the closed position, a lid spring fixed to the stationary cover member and contacting the displaceable lid portion for biasing the lid portion toward said open position, said spring comprising a wire coiled about said pivot member in a pair of locations with an intermediate uncoiled portion extending in contact with and resiliantly displaced so as to force the rotation of the lid portion about said pivot member, and a book-match retaining means pivotally engaging the portion of the frame exposed in the pair of apertures in the stationary cover for holding a conventional book of paper matches, the book-match retaining means comprising a depending elongated lip portion centrally disposed with respect to one long edge of the package closure for inserting between a back layer of the paper matches, and comprising a slot through which the enveloping cover of the book of paper matches may be inserted, the stationary cover member and the lid portion having impressed on a top surface thereof a decorative seam that resembles a cigarette package, the remainder of the top surface sloping slightly downwardly from said decorative seam, said lip portion being pivotally mounted for rotation to expose all outer surfaces of the book of paper matches.

* * * * *